United States Patent [19]

Tummel

[11] 4,141,261

[45] Feb. 27, 1979

[54] HYDRAULIC WRENCH

[76] Inventor: Harold Tummel, South Path, St. James, N.Y. 11780

[21] Appl. No.: 772,920

[22] Filed: Feb. 28, 1977

[51] Int. Cl.[2] ..... B25B 17/00

[52] U.S. Cl. ..... 81/57.11; 81/57.39; 81/57.44; 92/31

[58] Field of Search ..... 81/57.44, 57.11, 57.39; 74/25; 60/533; 92/31, 33; 408/137

[56] References Cited

U.S. PATENT DOCUMENTS

| | | | |
|---|---|---|---|
| 1,173,326 | 2/1916 | Taylor et al. | 92/31 |
| 2,131,815 | 10/1938 | Nilson | 60/533 |
| 3,438,451 | 4/1969 | Hayes | 92/31 |

FOREIGN PATENT DOCUMENTS

| | | | |
|---|---|---|---|
| 2026830 | 6/1970 | Fed. Rep. of Germany | 81/57.44 |

*Primary Examiner*—James L. Jones, Jr.

[57] ABSTRACT

A manually operable plunger extends rearwardly out of an elongated housing. An hydraulic force-multiplying system inside the housing causes a piston inside the housing to be moved forward when the plunger is pushed forward. A means causes an axially extending shaft that protrudes forwardly out of the housing to be rotated when the piston is moved forward. A conventional socket, as employed in a socket wrench, can be detachably secured to the front end of the shaft.

1 Claim, 2 Drawing Figures

HYDRAULIC WRENCH

SUMMARY OF THE INVENTION

The object of the invention is to provide a manually operable wrench that can be used to unscrew bolts and nuts that have been rusted or otherwise "frozen" and that require large amounts of torque to unscrew.

This invention works by utilizing an hydraulic force-multiplying system that is operated by pushing forwardly on a plunger. The system is contained inside an elongated housing from which rearwardly protrudes the plunger and from which forwardly protrudes an axially extending, rotatable shaft. When the plunger is pushed forwardly and the housing is held fixed, the shaft rotates. A conventional socket may be attached to the shaft.

Thus, such a socket can be placed over the nut or bolt to be unscrewed, and the plunger depressed. A large, easy forward movement of the plunger will result in a very large torque being applied at the nut or bolt through a small angle, loosening the nut or bolt and allowing it to be further unthreaded by other means or by repeated depressions of the plunger. To reset the device after the plunger has been fully depressed, the shaft is rotated in a sense opposite to that compelled by the action of the plunger.

DETAILED DESCRIPTION OF PREFERRED EMBODIMENTS

Figure 1:
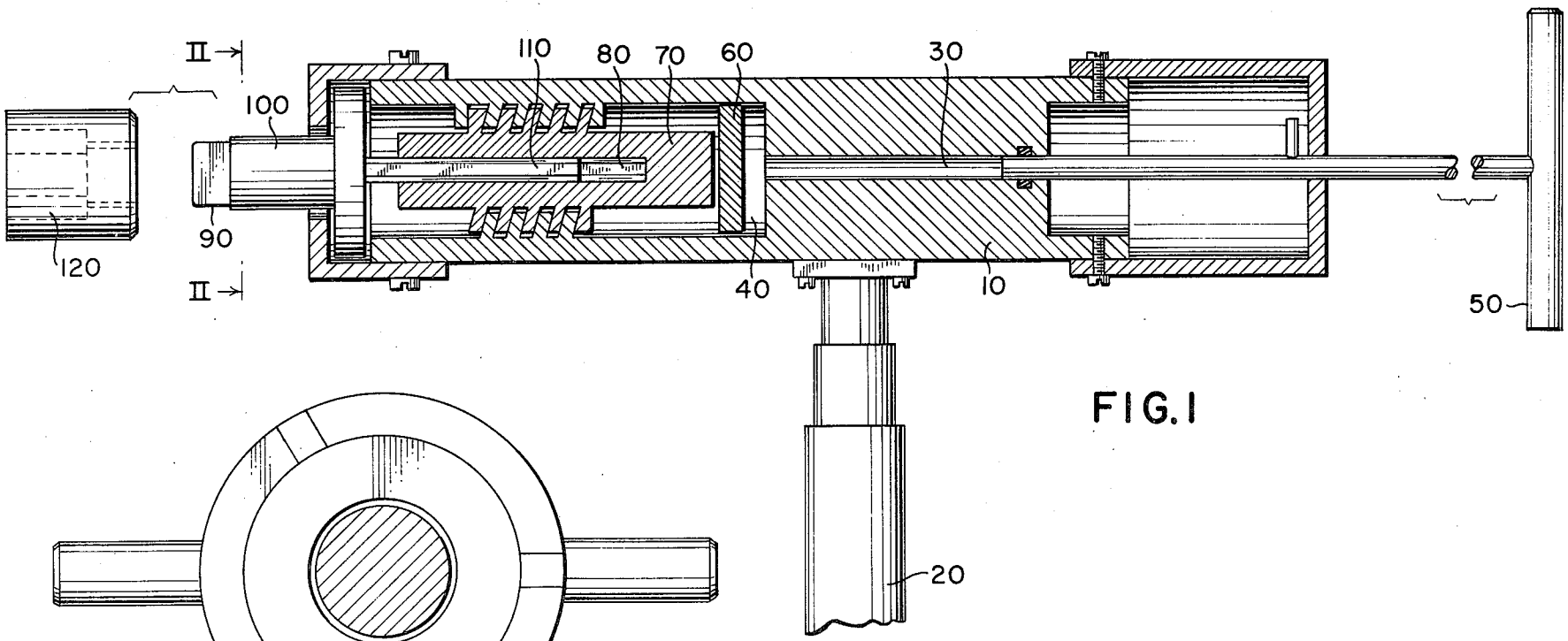
FIG. 1 shows a cross-sectional view of the invention.
Figure 2:
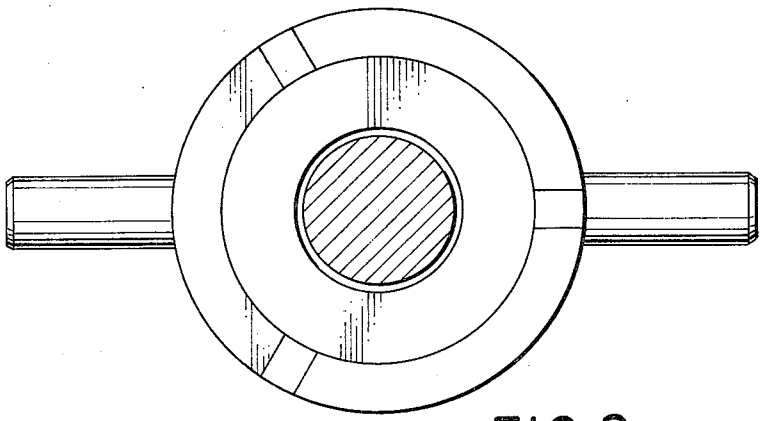
FIG. 2 shows a view along line II—II of FIG. 1.

A cylindrical, elongated housing 10 has a radially outwardly extending handle 20 which can be secured by the user to keep the housing fixed. Inside the housing are communicating and collinear first and second cylindrical shaped openings 30 and 40 respectively. The axes of the cylindrical shaped openings are collinear with the axis of the housing, and the second cylindrical opening has a larger cross-sectional area than the first cylindrical opening. A T-shaped plunger 50 extends rearwardly out of the housing, with the elongated stem of the plunger being located in and movable back and forth in the first cylindrical opening. A disc-shaped piston 60 is located in and movable back and forth in the second cylindrical opening. Hydraulic fluid fills the cylindrical openings between the plunger and the piston, creating a force-multiplying system wherein a small force applied for a long distance at the plunger is reflected in a large force applied for a short distance at the piston with the housing held fixed.

An elongated, axially extending worm gear 70 threadedly engages the housing directly forwardly of the piston. The gear has an elongated, hexagonal bore 80 extending axially rearwardly from its front end. It can be seen that the gear can be moved forwardly or rearwardly only with appropriate rotation about an axis collinear with the axis of the housing.

An axially extending shaft 90 with a square front end protrudes forwardly out of the housing. The shaft is located in hollow cylindrical sleeve 100 attached to the housing and is attached at its rear end to an hexagonal rod 110 that fits into the bore 80.

A conventional socket 120 can be detachably secured to the front end of the shaft by a spring-loaded ball or other conventional means. When the plunger is depressed, the piston is pressed forward and the gear is also pushed forward, rotating the hexagonal rod 110. This rotates the shaft and socket 120, causing the nut or bolt upon which the socket is placed to be unscrewed. To reset the device, the socket may be rotated in a sense opposite to that compelled by the plunger causing the gear to be advanced rearwardly, pushing the piston backwards and thus pushing the plunger rearwardly out.

Although the invention has been described with particular reference to the drawings, the protection sought is to be limited only by the terms of the claims which follow.

What is claimed is:

1. A hydraulic wrench, comprising:

a housing;

a first axially extending cylindrical opening in the housing;

a manually operable plunger in the first cylindrical opening which is movable axially back and forth therein;

a second axially extending cylindrical opening in the housing communicating with the first cylindrical opening and having a larger cross-sectional area than the first cylindrical opening;

a piston in the second cylindrical opening movable axially back and forth therein;

hydraulic fluid filling the cylindrical openings between the piston and the plunger, so as to form a force-multiplying hydraulic system which causes a given force applied for a given distance at the plunger to appear as a larger force applied for a smaller distance at the piston;

a radially outwardly extending handle which fixes secure the housing;

an axially extending shaft rotatably mounted in the housing and protruding forwardly therefrom;

an elongated, axially extending worm gear threadedly engaging the housing and located directly forwardly of the piston so as to be pushed axially forwardly thereby when the piston moves forward, the worm gear having an hexagonal bore extending axially rearwardly from the front of the gear;

an elongated hexagonal rod extending axially rearwardly from the rear end of the shaft and being located in the bore of the worm gear; and means for detachably securing a socket to the forward end of the shaft.

* * * * *